US005190211A

United States Patent [19]

Stoddard et al.

[11] Patent Number: 5,190,211

[45] Date of Patent: Mar. 2, 1993

[54] SNACK DISPLAY

[75] Inventors: David C. F. Stoddard, Atlanta; Ladd M. Orr, Clarkston, both of Ga.

[73] Assignee: The Mead Corporation, Dayton, Ohio

[21] Appl. No.: 874,375

[22] Filed: Apr. 27, 1992

[51] Int. Cl.[5] ..... A47B 3/00

[52] U.S. Cl. ..... 229/120.21; 108/111; 211/135; 248/174

[58] Field of Search ..... 108/111; 211/135, 149, 211/150, 153, 186; 248/152, 174; 229/120.15, 120.21; 206/44.12

[56] References Cited

U.S. PATENT DOCUMENTS

| | | | |
|---|---|---|---|
| 1,124,175 | 1/1915 | Sackett | 229/120.21 |
| 2,102,433 | 12/1937 | Nevins, Jr. | 229/120.21 |
| 2,113,288 | 4/1938 | Berger | 248/174 |
| 2,321,473 | 6/1943 | Ferguson | 229/104 |
| 3,656,611 | 4/1972 | Mertz | 206/44.12 |
| 3,877,396 | 4/1975 | Patterson | 211/186 |
| 4,311,100 | 1/1982 | Gardner et al. | 108/111 |
| 4,570,805 | 2/1986 | Smith | 248/174 |
| 4,618,115 | 10/1986 | Belokin, Jr. | 248/174 |
| 4,809,847 | 3/1989 | Schneider | 211/135 |
| 4,911,311 | 3/1990 | Nagai | 248/174 |

*Primary Examiner*—Gary E. Elkins
*Attorney, Agent, or Firm*—Rodgers & Rodgers

[57] ABSTRACT

A snack display is formed from a unitary blank. The blank includes a plurality of parallel spaced apart cross pieces together with a pair of side pieces foldably joined to opposite ends of the cross pieces respectively. The side pieces are of arcuate cross sectional configuration and planar panels are foldably joined to edges of the side pieces which are remote from the cross pieces. Outer edges of the planar panels which are remote from the side pieces are joined together and a plurality of shelves are foldably joined respectively to the cross pieces.

11 Claims, 3 Drawing Sheets

SNACK DISPLAY

TECHNICAL FIELD

This invention relates to point of purchase display devices such as are used in merchandising point of purchase items such as potato chips and the like.

BACKGROUND ART

One form of display utilizes corner posts which support shelves. U.S. Pat. No. 4,379,431 issued Apr. 12, 1983 and 4,886,171 issued Dec. 12, 1989 are owned by the assignee of this invention and are examples of such structures.

Another type of display comprises individual cases formed of paperboard which are stacked one atop another. An example of this type of display is disclosed in U.S. Pat. No. 4,182,244 issued Jan. 8, 1980 and owned by the assignee of this invention.

SUMMARY OF THE INVENTION

According to this invention in one form, a snack display is formed from a unitary blank having a plurality of parallel spaced apart cross pieces, a pair of side pieces foldably joined to opposite ends of said cross pieces respectively and which are of arcuate cross sectional configuration, planar panels foldably joined to edges of said side pieces which are remote from said cross pieces, means securing together edges of said planar panels which are remote from said side pieces and a plurality of shelves foldably joined respectively to said cross pieces and disposed in horizontal parallel relation to each other.

BEST MODE OF CARRYING OUT THE INVENTION

Figure 1:
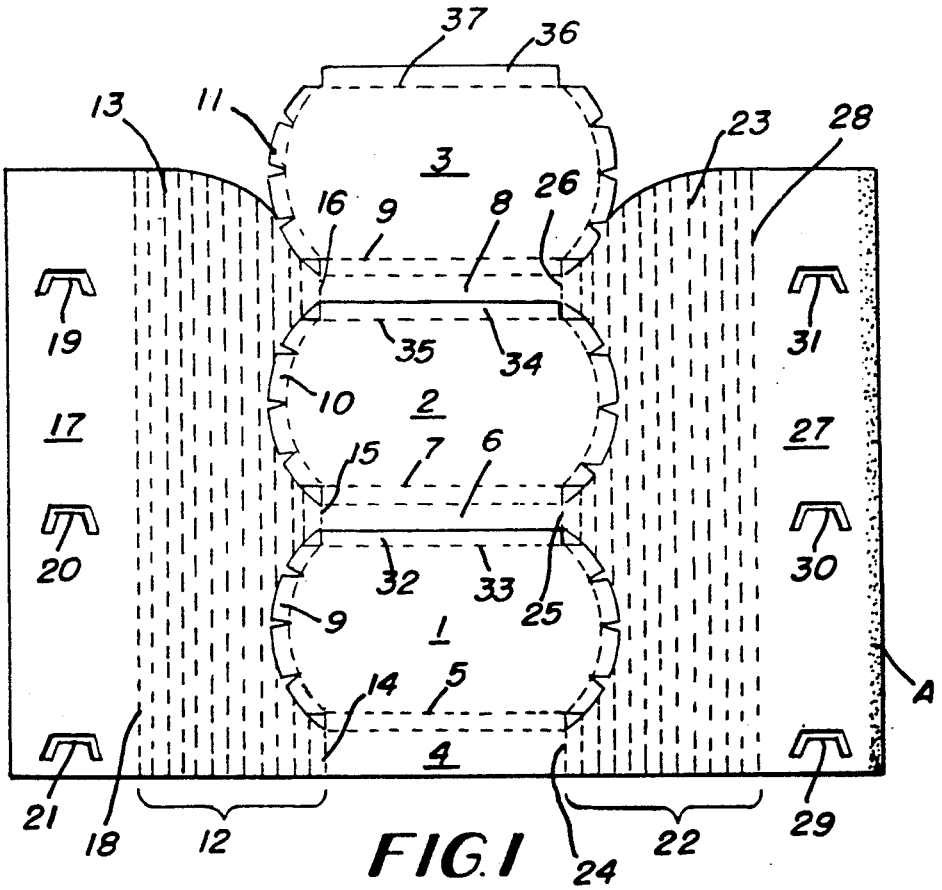
FIG. 1 is a plan view from which a display having three shelves is formed according to one aspect of this invention.

With reference to FIG. 1, the numerals 1, 2 and 3 designate three shelves incorporated into a display stand formed according to this invention. Shelf 1 is foldably joined to cross piece 4 along fold line 5 while shelf 2 is foldably joined to cross piece 6 along fold line 7. Similarly shelf 3 is foldably joined to cross piece 8 along fold line 9. Shelf 1 is provided with a plurality of end tabs such as are designated by numeral 9 while shelf 2 is similarly provided with a plurality of end tabs designated by the numeral 10. In like fashion, shelf 3 is provided with a plurality of end tabs designated by the numeral 11. Each of these end tabs 9, 10 and 11 is foldably joined to the end edge of the associated shelf as indicated by the dotted fold lines associated with each end tab.

Disposed along the left hand side of FIG. 1 and designated by the numeral 12 is a side piece having a plurality of parallel weakened fold lines designated by the numeral 13. Side piece 12 is foldably joined to the left hand ends of the shelves 1, 2 and 3 as indicated by the fold lines 14, 15 and 16.

Planar panel 17 is foldably joined along the fold line 18 to the side piece 12 as indicated in FIG. 1. A plurality of holding tabs 19, 20, and 21 are formed in planar panel 17 as best shown in FIG. 1.

At the other side of the blank, side piece 22 includes a plurality of parallel vertically disposed weakened fold lines 23. Side piece 22 is foldably joined to cross piece 4 along fold line 24 while side piece 22 is foldably joined to cross piece 6 along fold line 25. Similarly side piece 22 is foldably joined to cross piece 8 along fold line 26.

Planar panel 27 is foldably joined to side piece 22 along fold line 28 and includes holding tabs 29, 30 and 31. A shelf supporting strip 32 is foldably joined along fold line 33 to the rear edge of shelf 1 while shelf supporting strip 34 is foldably joined to the rear edge of shelf 2 along fold line 35. Similarly shelf supporting strip 36 is foldably joined to the rear edge of shelf 3 along fold line 37.

Figure 2:
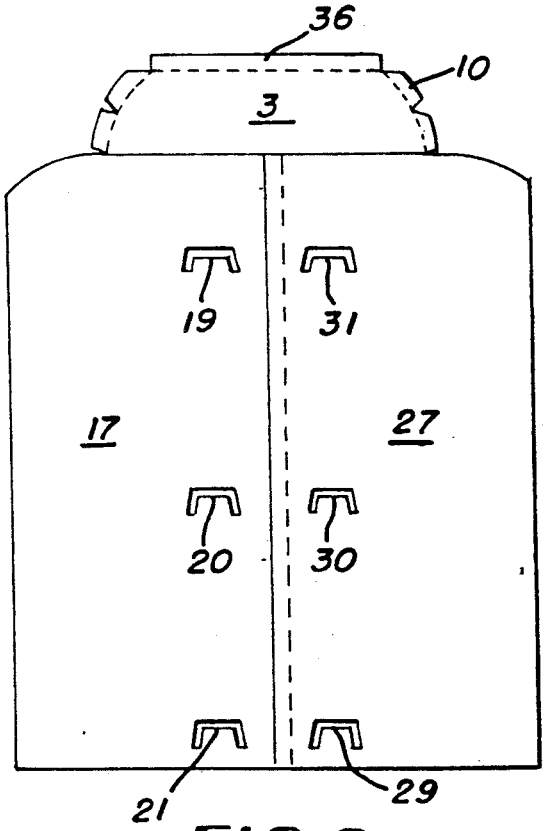
FIG. 2 is a rear view of a display stand formed from the blank shown in FIG. 1 in partially assembled condition.
Figure 3:
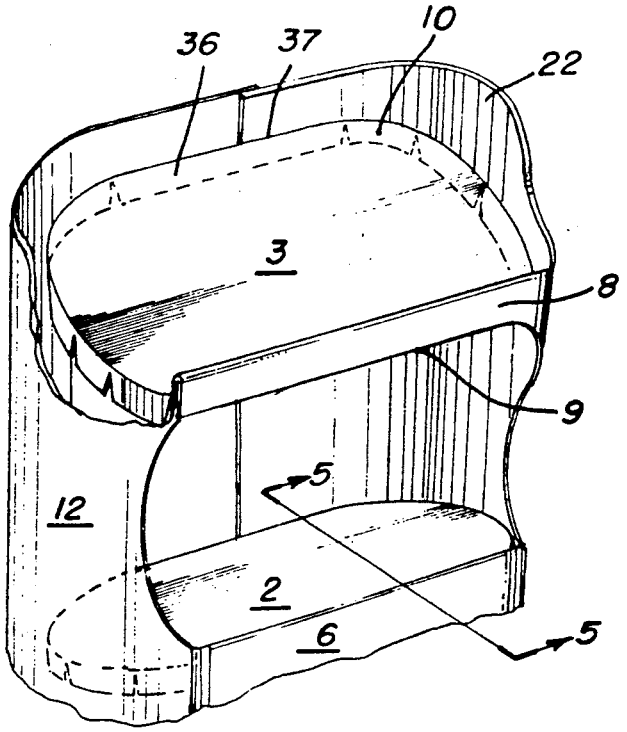
FIG. 3 is a perspective view of the upper end of a display device formed according to this invention and which shows the upper parts in the positions which they occupy during formation of the display.
Figure 4:
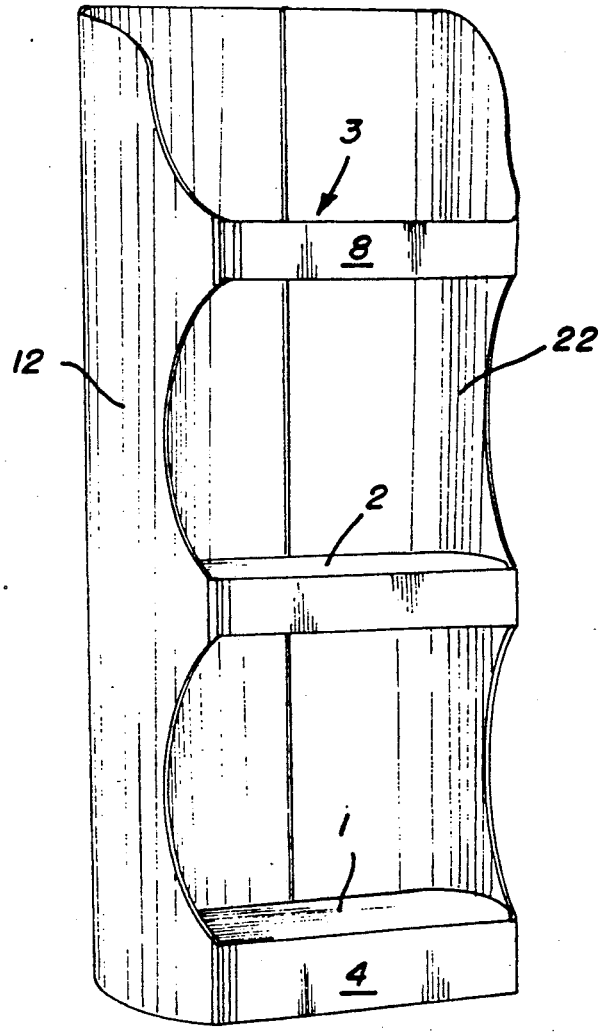
FIG. 4 is a perspective view of a completed display stand formed according to this invention.
Figure 5:
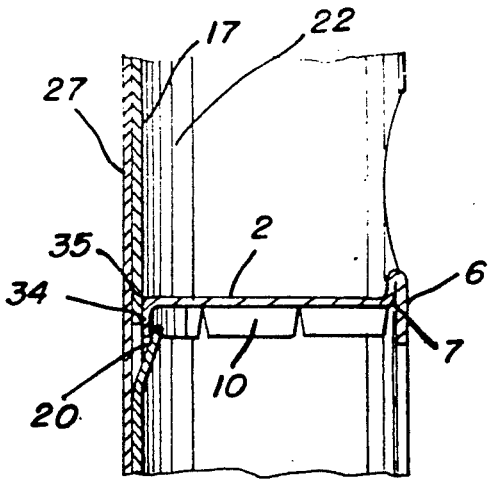
FIG. 5 is a cross sectional view taken along the line designated 5—5 in FIG. 3.

In order to manipulate the blank as shown in FIG. 1 into the partially set up condition represented in FIGS. 2 and 3, the planar panel 17 together with the side piece 12 are elevated and folded to the right along fold lines 14, 15 and 16. In like fashion, the planar panel 27 together with side panel 22 are elevated and folded toward the left along fold lines 24, 25 and 26. The adhesive indicated at A in FIG. 1 formed along the right hand edge of planar panel 27 overlies the left hand edge of planar panel 17 and the structure then appears as shown in FIG. 2.

FIG. 3 shows the upper parts of the structure during an intermediate stage of a setting up operation. From FIG. 3 it is apparent that shelf 3 is being folded downwardly and so that ultimately shelf supporting strip 36 may move behind the holding tabs 19 and 31 while the end tabs such as 10 are folded downwardly and the arcuate configuration of the ends of the shelves coincides with the arcuate configuration of side pieces 12 and 22 as indicated in FIG. 3.

Ordinarily a snack display formed according to this invention is constructed of corrugated paperboard and thus is inexpensive to construct and is mechanically strong due to the inherent mechanical characteristics of corrugated paperboard.

Figure 6:
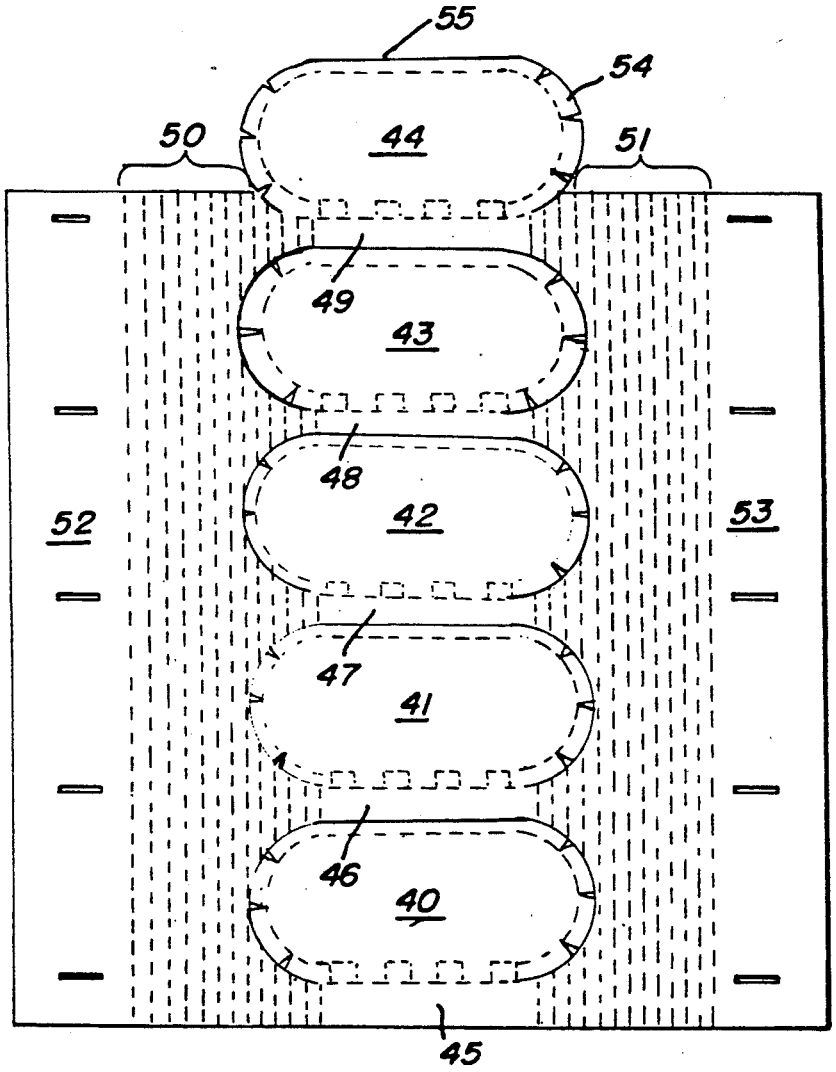
FIG. 6 is a plan view of a unitary blank somewhat similar to FIG. 1 but which is used in the formation of a display device having five shelves.

While the structure shown in FIG. 6 is basically quite similar to the structure shown in FIG. 1, this view is being included so as to indicate that displays of a different number of shelves are feasible and practical according to this invention. For example and with reference to FIG. 6 the shelves 40, 41, 42, 43 and 44 may be struck from a single piece of paperboard and the cross pieces 45–49 inclusive correspond to the cross pieces 4, 6 and 8 in FIG. 1. Also, the side pieces 50 and 51 correspond with the side pieces 13 and 23 in FIG. 1 and the planar panels 52 and 53 as shown in FIG. 6 correspond to planar panels 17 and 27 as shown in FIG. 1. The end tabs such as 54 of FIG. 6 correspond to the end tabs 11 in FIG. 1 and the shelf supporting strips such as that indicated at 55 correspond with strips 32, 34 and 36 as best shown in FIGS. 1, 2 and 3.

According to this invention, a mechanically strong economical display such as is feasible for point of purchase use is provided at an economical cost and at sizes which are readily adjustable for particular purposes.

We claim:

1. A snack display comprising a plurality of parallel spaced part cross pieces, a pair of side pieces foldably joined to opposite ends of said cross pieces respectively and which are of arcuate cross sectional configuration, planar panels foldably joined to edges of said side pieces which are remote from said cross pieces, means securing together edges of said planar panels which are remote from said side pieces and a plurality of shelves each having ends and a rear edge foldably joined respectively to said cross pieces and disposed in horizontal parallel relation to each other.

2. A snack display according to claim 1 wherein the ends of said shelves are of arcuate complementary configuration to said side pieces respectively.

3. A snack display according to claim 1 wherein a plurality of end tabs are foldably joined to each end edge of each of said shelves.

4. A snack display according to claim 1 wherein a holding tab is struck from at least one of said planar panels and arranged to cooperate with a shelf supporting strip foldably joined to the rear edge of each of said shelves.

5. A snack display according to claim 1 wherein each of said side pieces includes a plurality of weakened vertical parallel fold lines to aid in establishing and in maintaining said arcuate cross sectional configuration of said side pieces.

6. A snack display according to claim 1 wherein said means securing edges of said planar panels comprises adhesive arranged to secure adjacent edges of said planar panels in overlapping relation.

7. A snack display according to claim 1 wherein said unitary blank is formed of corrugated paperboard.

8. A unitary blank comprising a first planar panel, a first side piece foldably joined to a side edge of said first planar panel and having a plurality of weakened fold lines ,a plurality of cross pieces in parallel relation and each having one end foldably joined to an edge of said first side piece, a second side piece foldably joined to the other end of said cross pieces and having a plurality of weakened fold lines, a second planar panel foldably joined to said second side piece along a part remote from said cross pieces, and a plurality of shelves foldably joined respectively to an edge of each of said cross pieces.

9. A unitary blank comprising a first planar panel, a first side piece foldably joined to a side edge of said first planar panel, a plurality of cross pieces in parallel relation and each having one end foldably joined to an edge of said first side piece, a second side piece foldably joined to the other end of said cross pieces, a second planar panel foldably joined to said second side piece along a part remote from said cross pieces, each of said side pieces having a plurality of fold liens arranged in parallel relation to a side edge of the adjacent one of said planar panels, and a plurality of shelves foldably joined respectively to an edge of each of said cross pieces.

10. A unitary blank comprising a first planar panel, a first side piece foldably joined to a side edge of said first planar panel, a plurality of cross pieces in parallel relation and each having one end foldably joined to an edge of said first side piece, a second side piece foldably joined to the other end of said cross pieces, a second planar panel foldably joined to said second side piece along a part remote from said cross pieces, a plurality of end tabs foldably joined to each end edge of each of said shelves, and a plurality of shelves foldably joined respectively to an edge of each of said cross pieces.

11. A unitary blank according to claim 10 wherein a shelf supporting strip is foldably joined to the rear edge of each of said shelves.

* * * * *